US005813157A

United States Patent [19]

Scott et al.

[11] Patent Number: 5,813,157

[45] Date of Patent: Sep. 29, 1998

[54] SHOTGUN STOCK WITH SHELL HOLDER

[76] Inventors: Barry R. Scott, 41162 Montelimar Crt., Murrieta, Calif. 92562; Richard D. Wade, 1014 W. Woodcrest Ave., Brea, Calif. 92821

[21] Appl. No.: 845,220

[22] Filed: Apr. 21, 1997

Related U.S. Application Data

[63] Continuation-in-part of Ser. No. 55,659, Jun. 10, 1996, Pat. No. Des. 382,037.

[51] Int. Cl.[6] ..... F41C 23/00

[52] U.S. Cl. ..... 42/71.01

[58] Field of Search ..... 42/71.01

[56] References Cited

U.S. PATENT DOCUMENTS

| | | | |
|---|---|---|---|
| 223,100 | 12/1879 | Bell | 42/89 |
| 711,989 | 10/1902 | Marble | 42/6 |
| 1,526,847 | 2/1925 | Fritz | 42/71.01 |
| 3,722,125 | 3/1973 | Switzer | 42/89 |
| 3,744,170 | 7/1973 | Jensen | 42/87 |
| 3,921,326 | 11/1975 | Hupp et al. | 42/89 |
| 4,850,127 | 7/1989 | Davis et al. | 42/71.01 |
| 4,860,478 | 8/1989 | Clayton | 42/71.01 |
| 5,068,991 | 12/1991 | Reed | 42/71.01 |
| 5,159,136 | 10/1992 | Marsh | 42/71.01 |
| 5,261,178 | 11/1993 | Samish | 42/89 |

*Primary Examiner*—Charles Jordan
*Assistant Examiner*—Meena Chelliah
*Attorney, Agent, or Firm*—Edgar W. Averill, Jr.

[57] ABSTRACT

A shotgun stock including a shell holding compartment. The shell holding compartment is completely contained within the confines of the shotgun stock so that it does not extend outwardly in either direction from the stock. The shell holder is several clips facing either the right side or the left side of the stock. Shells may be snapped in or removed from the clip and the shells are also completely contained within the confines of the stock. Preferably, the stock includes a pistol grip portion so that the shotgun may be held by one hand. Also, preferably, the opening in the stock is divided by a partition with the clips in the rear partition and the hand holding pistol grip at the front of the front opening.

10 Claims, 2 Drawing Sheets

SHOTGUN STOCK WITH SHELL HOLDER

BACKGROUND OF THE INVENTION

This application is a continuation-in-part of applicants' design patent, Ser. No. 29/055,659, patented on Jun. 10, 1996 U.S. Pat. No. D 382,037.

The field of the invention is firearms and the invention relates more particularly to shotgun stocks.

Various accessories are known for holding shells to the stock of a gun. An early U.S. Pat. No. 1,110,209 shows a gun clip which was attachable to a stock held to a pistol and which has a series of cartridge holders 5 affixed to the right and left sides of the stock. In U.S. Pat. No. 2,476,355, a gun stock has a number of holes drilled into the top of the stock and rifle shells are held in these holes with the rim of the shells extending slightly above the top of the stock.

A hinged stock is shown in U.S. Pat. No. 3,798,819 where shells are held on the under surface of the stock. U.S. Design Pat. No. 297,855 shows a rifle stock with an opening containing a plate. Lastly, U.S. Pat. No. 4,115,943 shows a firearm with a reserve clip held in the stock.

It is important that the shells be completely retained within the stock to facilitate the placement and removal of the shotgun from a case. The device shown in U.S. Pat. No. 1,110,209 would have the ammunition extending outwardly from the stock which would interfere with the placement or removal of the firearm into a case, as well as interfering with the use of it in that it would catch on loose clothing and the like. The device of U.S. Pat. No. 2,476,355 presents a potential safety hazard since the cap of the shell is exposed. The device of U.S. Pat. No. 3,798,819 also has the disadvantage of having the shells protrude from the firearm when it is being placed into or removed from a holder as well as extending outwardly when the shotgun is placed on the ground or other surface. The clip of the firearm of U.S. Pat. No. 4,115,943 has to first be removed from the stock and the ammunition removed from the clip. Of course, it is designed for the clip to be inserted into the firearm whereas in the case of most shotguns it is necessary to remove and insert individual shells.

There is thus a need for a shell holder for shotguns which is out, of the way and does not interfere with the use, storage or removal from storage of the shotgun.

BRIEF SUMMARY OF THE INVENTION

It is an object of the present invention to provide a shotgun with a shell holder which is completely surrounded by the confines of the shotgun stock.

The present invention is for a shotgun stock with a shell holder. The shotgun stock includes a butt, a top, a bottom, a right side and a left side and a front which is attached to a shotgun barrel and mechanism assembly. An opening is formed through the stock from the right side to the left side and the opening has a top, a right side coincident with the right side of the stock, a left side coincident with the left side of the stock, a front edge separated from the front of the stock and a back edge separated from the butt of the stock. A shotgun shell holder is completely contained between the sides of the opening so that it does not extend outwardly from the shotgun stock. The shell holder is preferably a clip assembly affixed to the bottom of the opening. Preferably, the shotgun shells may be inserted or removed laterally into one of the clips. It is also preferable that the opening extend to the back of a pistol grip portion of the stock and that the opening be divided by a partition with the front part left clear for the users hand and the rear portion holding the clip assembly.

DESCRIPTION OF THE PREFERRED EMBODIMENTS

Figure 1:
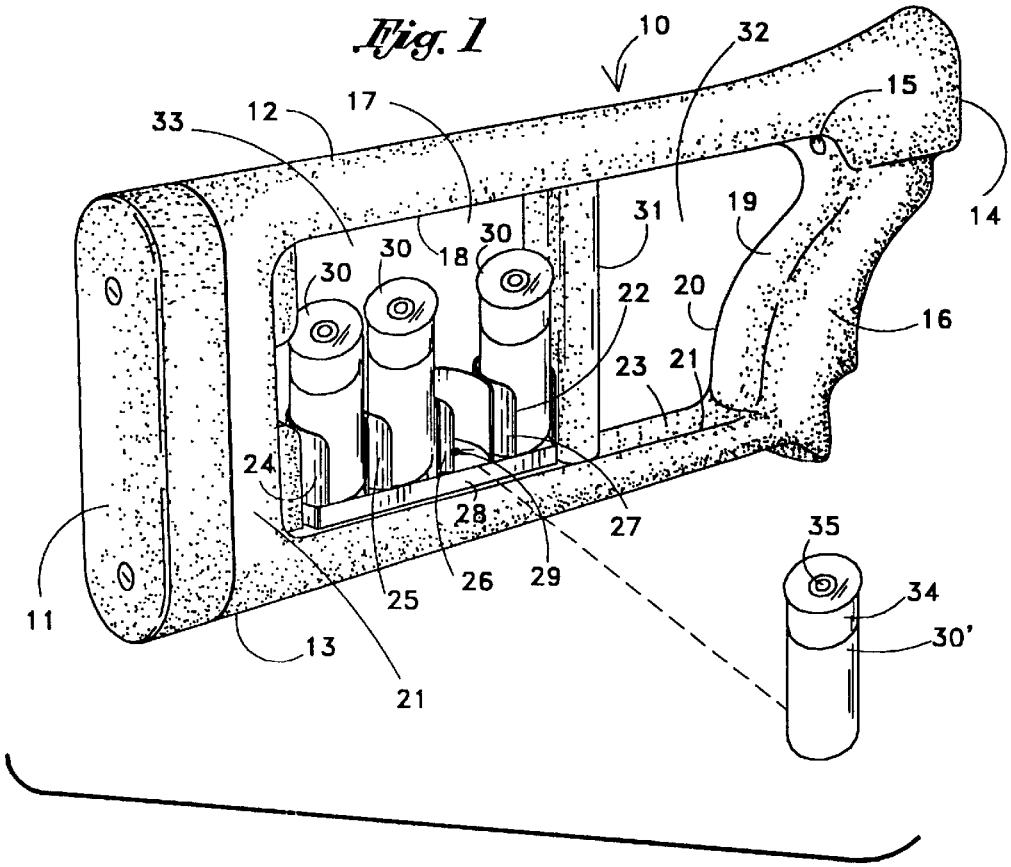
FIG. 1 is a perspective view showing the shotgun stock with a shell holder of the present invention.
Figure 2:
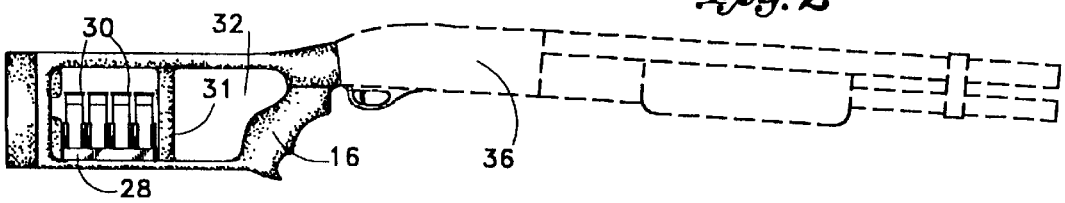
FIG. 2 is a right side view thereof showing the shotgun barrel and mechanism assembly in phantom view.
Figure 3:
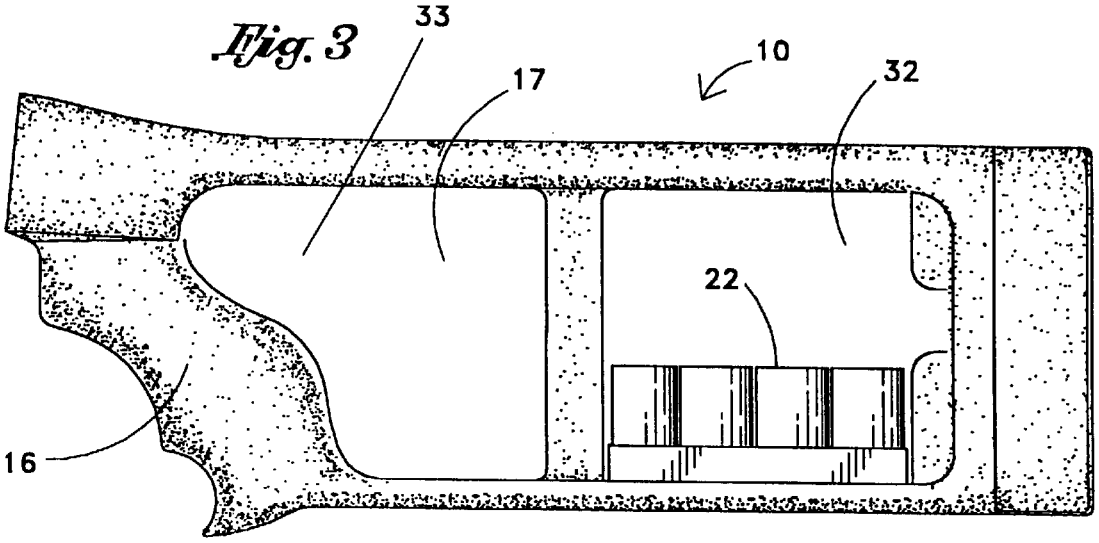
FIG. 3 is a left side view thereof.

A shotgun stock is shown in perspective view in FIG. 1 and indicated generally by reference character 10. The stock has a butt 11, a top 12, a bottom 13 and a front 14. The front 14 of the stock includes means for attachment to a shotgun barrel and mechanism assembly where an opening 15 permits the insertion and tightening of a bolt for this purpose, although, of course, other attachment means can be used.

Figure 4:
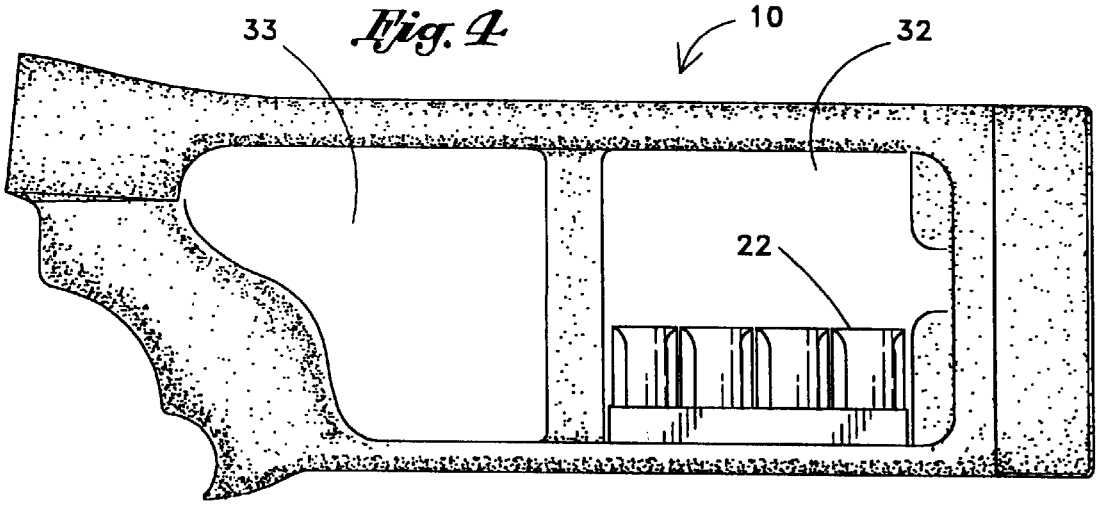
FIG. 4 is a left side view thereof with the clip assembly reversed.
Figure 5:
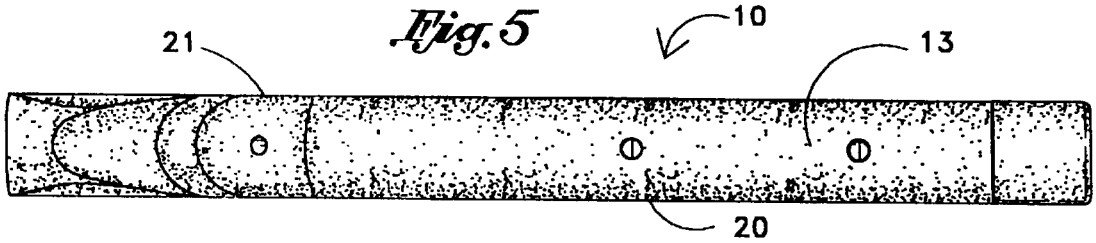
FIG. 5 is a bottom view thereof.

Shotgun stock 10 includes a pistol grip 16 which permits the shotgun to be held in one hand more easily than it is with a conventional shotgun stock. Stock 10 has an opening generally indicated by reference character 17. Opening 17 has a top 18, a front edge 19, a left side 20 and a right side 21. Left side 20 is coincident with the left side of shotgun stock 10 and right side 21 is coincident with the right side of shotgun stock 10. A shotgun shell holding clip assembly 22 is held against the bottom 23 of opening 17 and consists of four spring clips 24, 25, 26 and 27, all held on a base 28. The base 28 is held against the bottom 23 of opening 17 by a pair of screws 29. Screws 29 may be removed and the clip assembly 22 turned 180° so that the shells may be inserted and removed from the left side when the shotgun is used by left handers. The positioning is shown in FIG. 4.

Four shotgun shells 30 are shown in FIG. 1 and these shells may be removed and inserted from the right side as indicated by removed shotgun shell 30'.

A partition 31 divides opening 17 into a front opening 32 and a rear opening 33. The clip assembly 22 is positioned in the rear opening 33 which leaves the front opening free for the user's thumb and palm when gripping pistol grip 16. The shells are held with their rims 34 facing upwardly and the cap portion 35 is held within opening 17 so that the gun could be dropped or placed down without any possible contact with cap portion 35.

The result of the placement of clip assembly 22 completely within the confines of the shotgun stock 10 permits the shotgun to be easily placed into a shotgun case or removed therefrom since it does not protrude in any way from the sides of the stock. Furthermore, in use, neither the shells nor the clip tend to catch in clothing because of their recessed nature. Still further, because the shells extend substantially above the clip, they are very easily removed by placing a finger over the rim of the shell and pulling it sideways. Preferably, the clips are formed of a flexible polymer such as ABS, although they could be fabricated from spring steel.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A shotgun stock with a shell holder comprising:

a shotgun stock having a butt, a top, a bottom, a right side and a left side, and a front which includes means for attachment to a shotgun barrel assembly;

an opening through said stock from said right side to said left side creating an open passageway from said right side to said left side, said opening having an opening top, an opening right side coincident with the right side of the stock, an opening left side coincident with the left side of the stock, an opening front edge separated from the front of the stock, and an opening back edge separated from said butt; and a shotgun shell holder completely contained between said opening so that it does not extend outwardly from the shotgun stock.

2. The shotgun stock of claim 1 wherein said shotgun shell holder is a clip assembly affixed to said opening bottom, said clip assembly having a plurality of spring clips facing one of said right and left sides so that a shotgun shell may be inserted laterally into one of said clips.

3. The shotgun stock of claim 2 wherein there are four of said clips.

4. The shotgun stock of claim 2 wherein said opening contains a dividing post dividing the opening into a front portion and a rear portion and said clip assembly is located in said rear portion.

5. The shotgun stock of claim 4 wherein said front portion includes a rear portion of a pistol grip so that the shotgun may be held with one hand.

6. The shotgun stock of claim 2 wherein said clip assembly is removable and installable so that it opens either toward the right or left side of said shotgun stock.

7. A shotgun stock with a shell holder comprising:

a shotgun stock having a butt, a top, a bottom, a right side and a left side, and a front which includes means for attachment to a shotgun barrel assembly;

an opening through said stock from said right side to said left side creating an open passageway from said right side to said left side, said opening having an opening top, an opening right side coincident with the right side of the stock, an opening left side coincident with the left side of the stock, an opening front edge separated from the front of the stock, and an opening back edge separated from said butt;

a generally vertical partition dividing said opening into a front portion and a rear portion;

a pistol grip portion positioned adjacent said front portion of said opening adjacent said front of said shotgun stock and gripable by a user's hand so that a portion of the user's hand is within said front portion; and a shotgun shell holder completely contained between the right and left sides of said front portion of said opening so that it does not extend outwardly from the shotgun stock.

8. The shotgun stock of claim 7 wherein said holder is a polymeric clip assembly having a plurality of clips having clip openings facing toward one of the right and left sides of said stock so that a shotgun shell may be laterally inserted into or removed from one of the clips from one of said right and left sides.

9. The shotgun stock of claim 8 wherein the clip assembly is removable and installable so that the clip openings may face either the right side or the left side of the stock.

10. The shotgun stock of claim 9 wherein there are four clips.

* * * * *